United States Patent [19]

Hernandez

[11] Patent Number: 4,583,682

[45] Date of Patent: Apr. 22, 1986

[54] AIR CONDITIONING MONITORING DEVICE

[75] Inventor: Orlando Hernandez, Miami, Fla.

[73] Assignee: Florida Energy Control Corp., Miami, Fla.

[21] Appl. No.: 592,106

[22] Filed: Mar. 22, 1984

[51] Int. Cl.[4] ..... F23N 5/20

[52] U.S. Cl. ..... 236/46 R; 165/11.1; 165/12

[58] Field of Search ..... 165/11 R, 12, 22; 236/46 R, 94

[56] References Cited

U.S. PATENT DOCUMENTS

| | | | |
|---|---|---|---|
| 3,730,429 | 5/1973 | Minto | 165/11 R X |
| 3,777,803 | 12/1973 | Wood | 165/12 X |
| 3,979,060 | 9/1976 | Tierce | 165/12 X |
| 3,995,686 | 12/1976 | Laube | 165/11 |
| 4,265,298 | 5/1981 | Sumner, Jr. et al. | 165/12 X |
| 4,272,012 | 6/1981 | Molnar et al. | 236/46 R X |
| 4,363,441 | 12/1982 | Feinberg | 165/11 R X |
| 4,412,647 | 11/1983 | Lampert | 165/11 R X |
| 4,484,620 | 11/1984 | McHugh | 165/11 R |

FOREIGN PATENT DOCUMENTS

| | | | |
|---|---|---|---|
| 2377582 | 9/1978 | France | 165/11 R |

*Primary Examiner*—Albert W. Davis, Jr.
*Assistant Examiner*—Randolph A. Smith
*Attorney, Agent, or Firm*—Jesus Sanchelima

[57] ABSTRACT

An electric device for monitoring the usage of equipment that is being shared by one or more entities or individuals during a predetermined schedule and that needs to be made available to any one of these entities or individuals outside that schedule. The device includes timing means programmable for any schedule and capable of activating complementary relays, one of them a normally open and the other one a normally closed. The contacts of one of these relays being connected to a suitable point in the equipment being shared so that its operation may be interrupted or turned on. A plurality of second relay means, one associated with each one of the entities, are also connected to that point in the equipment so that each entity may be able to connect the equipment. Also, there is an elapsed time meter associated with each one of those second relay means so that the time that the equipment is used, outside the predetermined schedule, by a particular entity may be measured.

2 Claims, 2 Drawing Figures

AIR CONDITIONING MONITORING DEVICE

BACKGROUND OF THE INVENTION

1. Field of the Invention

The present invention relates to time monitoring devices and more particularly to such devices that make commonly used equipment available to one or more persons or entities for a predetermined schedule and to provide the flexibility of extending it.

2. Description of the Prior Art

It is usual to find agreements between the owner of a particular equipment with one or more entities for its use during a schedule that is agreed upon ahead of time. The most common example is a landlord that contracts with tenants, in a multiple unit, office building, to maintain adequate air conditioning from Monday to Friday, from 8:00 AM to 6:00 PM. It is not unusual that a particular tenant needs to extend its working hours beyond the contracted schedule, i.e., accountants near tax deadlines. The landlord usually needs to be notified ahead of time to make the proper arrangement. The present invention allows each individual tenant to switch on and off the use of the air conditioning system beyond the contracted schedule without giving notice to the landlord. The landlord only needs to read the elapsed time meter associated with each tenant and charge for this extra service accordingly. Also, the landlord may leave the air conditioning system off for the weekends, for example, and allowing any of the tenants to turn it on if needed. This would eliminate the compromise usually found in these situations which call for maybe one half of a day service on Saturdays, or the like. This arrangement saves energy.

Applicant believes that the closest reference corresponds to U.S. Pat. No. 3,995,686, issued to Herbert L. Laube. However, it differs from the present invention because this device measures the time that a compressor or heater is in operation and the present device measures the time of each person (tenant) individual use outside the predetermined schedule.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide a device that allows the building owner or operator to set a minimum operating schedule (a major energy conservation technique) while allowing the tenant or equipment user of the equipment that require overtime use of the equipment to do so with a minimum of complication to extend the time of its use beyond a predetermined schedule without requiring giving notice to the owner.

Another object of the present invention is to provide a device that may be used in a multiple office unit building and allow each tenant to obtain air conditioning service beyond the contracted schedule.

Further objects of the invention will be brought out in the following part of the specification, wherein detailed description is for the purpose of fully disclosing the invention without placing limitations thereon.

DESCRIPTION OF THE DRAWING

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
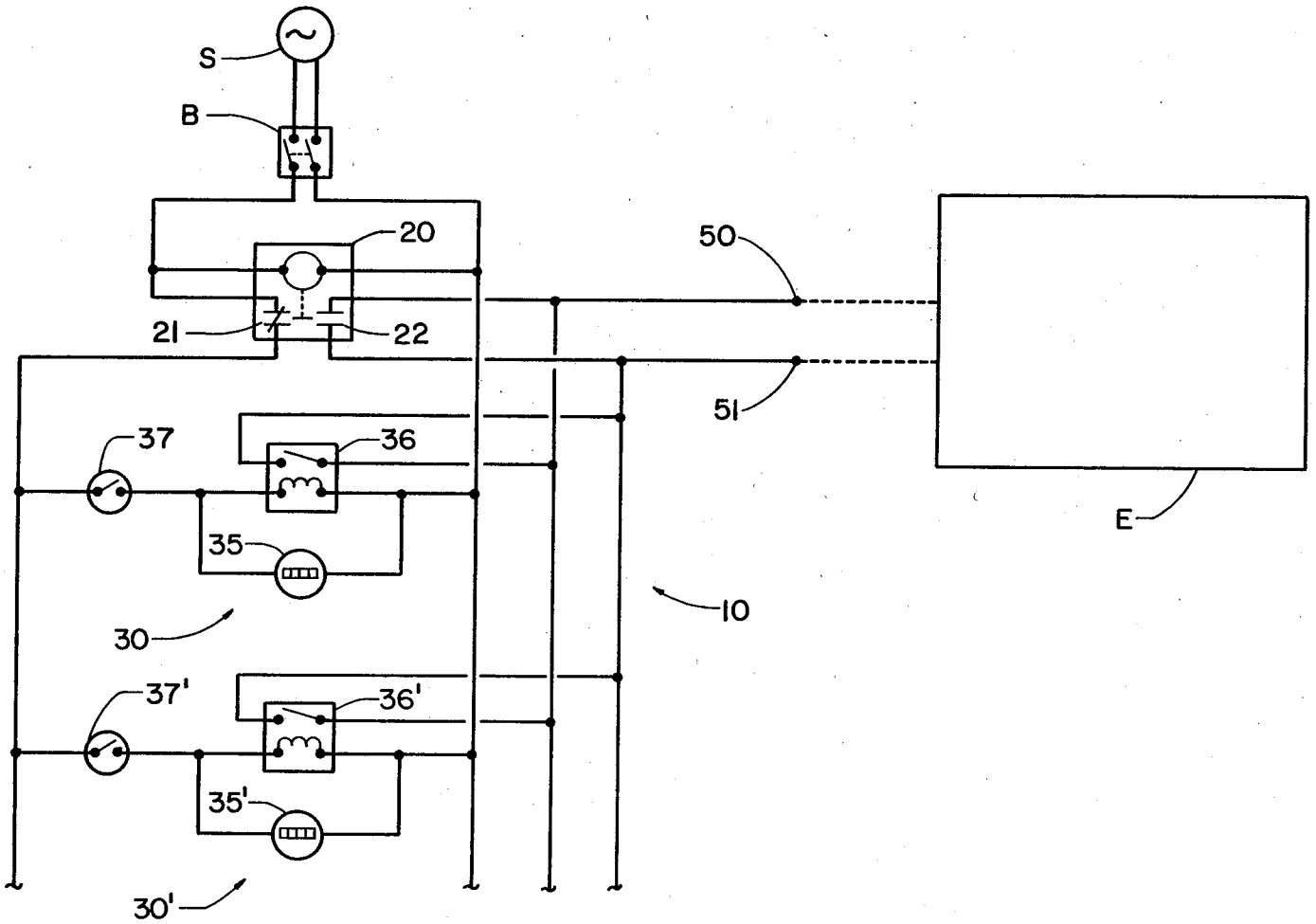
FIG. 1 represents the circuit of the present invention using electro mechanical devices.

Referring now to FIG. 1 where the present invention is referred to numeral 10 and the equipment being used is referred to with the letter E. The circuit of equipment E is interrupted at terminals 50 and 51 which are connected or disconnected by device 10, as it is described below.

Time monitoring device 10 is powered by an electric source S through protective circuit breaker B. A main timer 20 is energized by this electric source. Timer 20 includes a normally closed relay 21 and normally open relay 22 which are controlled simultaneously. Main timer 20 is set in the preferred embodiment so that normally open relay 22 closes during the contracted schedule for which equipment E will be made available to the user or users and during this time normally closed relay 21 will be open. Of course, relays 21 and 22 may be interchanged and the timer 20 programmed in reverse. In the preferred embodiment the equipment being shared by two users corresponds to an air conditioning system in a multiple tenant office building so timer 20 is programmed on a 7 days basis from 8:00 AM to 6:00 PM, Mondays through Fridays. The contacts of relay 22 are directly connected to terminals 50 and 51 so that if timer 20 is within the contracted time then equipment E is in operation. One of the contacts of relay 21 is connected to one of the poles of source S and the other contact is commonly connected to one end of the individual time monitoring circuits 30 and 30'. The other end of circuits 30 and 30' are connected to the other pole of source S. In the preferred embodiment only two individual time monitoring circuits are shown corresponding to two individual users or tenants. However, it is understood that there are as many circuits like the 30 and 30' circuits as tenants or users exist. Circuit 30 (and 30') includes elapsed time meter 35 which is connected in parallel with the coil of normally open relay 36. Switch 37 is connected in series with the relay 36 and elapsed time meter 35 combination. When normally open switch 37 is closed, the coil of relay 36 is activated which closes the contacts of relay 36. Normally open switches 37; 37' etc. may be controlled through timers, computers or any other programmable means. These contacts are electrically connected to terminals 50 and 51 thereby activating equipment E. During this time, elapsed time meter 35 is activated thereby measuring the time that this particular user has caused equipment E to be energized outside the contracted time. Switch 37 could be a single pole switch or a timer switch that could be set to close for a predetermined time. Ideally, switch 37 would be placed in a secure location accessible only by the authorized agents of the tenant.

Figure 2:
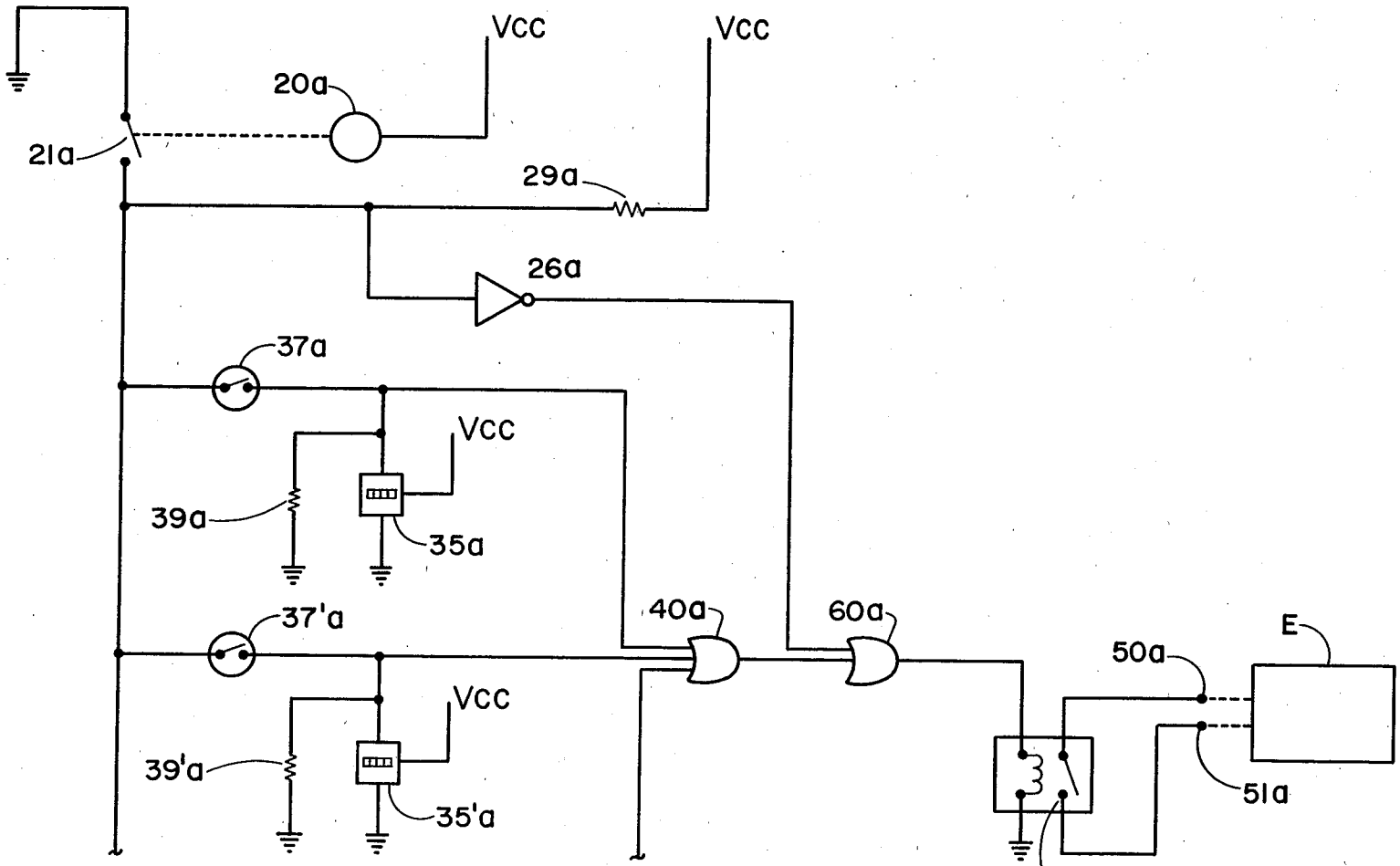
FIG. 2 is a schematic representation of a logical circuit that implements the functions of the circuit of FIG. 1.

An alternative electronic embodiment is shown in FIG. 2 wherein a timer **20*a* controls normally open switch 21***a* which is connected on one end to ground which represents logic state "0". The other end of switch 21*a* is connected through resistor 29*a* to supply voltage Vcc which represents logic state "1". Also, there are two other connections to this other end of switch 21*a*. One of the connections is to the input of inverter 26*a* and the other connection is to a point where a plurality of commonly connected individual tenant switches 37*a*, 37'*a*, etc. are connected. Normally open switches 37*a* are commonly connected on one end and the other end being connected to the enabling input of a quartz digital clock 35*a*, which is connected to ground through resistor 39*a* in order to avoid picking up noise, and also connected to one of the inputs of OR gate 40*a*. The other switches in parallel, 37*a*; etc. have similar connections. The output of inverter 26*a* is connected to one of the two inputs of OR gate 60*a* and the other input is connected to the output of gate 40*a*. The output of gate 60*a* activates relay 22*a* which closes the circuit that enables equipment E to operate. Relay 22*a* could be a plurality of relays and equipment rather than just one.

The operation of the circuit shown in FIG. 2 is as follows: during a predetermined time period for which equipment E must be on, timer 20*a* causes switch 21*a* to be closed which makes the output of inverter 26*a* a logic "1" which in turn is gated through OR gate 60*a* thereby activating relay 22*a* and enabling equipment E. Also, the ground level, or "0" state, transmitted through switch 21*a* is applied to the common end of the plurality of switches 37*a*; 37'*a*; etc. thereby keeping a "0" level at the enabling input of clock 35*a* which will not make it run. Therefore, during this predetermined period it is inmaterial what the position is for any of the switches in the plurality of swtiches since they will not activate their associated clocks 35*a*; 35*a*; etc. When switch 21*a* is open, either manually or through timer 20 or any other programmable device, then pull-up resistor 29*a* connected to a logic "1" voltage brings the level up causing the output of inverter 26*a* to go to "0" thereby deactivating relay 22*a*. At this point, any of the plurality of switches 37*a*; 37'*a*; etc. would, if closed, transmit a "1" that would activate its associated clocks 35*a*; 35'*a*; etc. and this "1" would be gated through OR gates 40*a* and 50*a* thereby activating relay 22*a* and making equipment E operable. Each individual tenant would be charged for the time of equipment use and the location of switches 37*a*; 37'*a*; etc. would be in secure places only accessible to a particular tenant or user assigned.

It is believed the foregoing description conveys the best understanding of the objects and advantages of the present invention. Different embodiments may be made of the inventive concept of this invention. It is to be understood that all matter disclosed herein is to be interpretted merely as illustrative, and not in a limiting sense, except as set forth in the following appended claims.

What is claimed is:

1. An electric device for monitoring the usage of shared equipment, by each user, during a period of time selected by the user and outside a predetermined schedule, comprising, in operative combination:

a. electric power source means having at least two output poles connected to said device;

b. timing means including complementary normally closed and open relay means, said normally closed relay means having one relay contact connected to one pole of said source means and said normally open relay means having relay contacts connected to a suitable place on the circuit of said equipment to achieve equipment switching on and off, and both of said relay means being activated by said timing means;

c. a plurality of normally open relay means including two contacts having one of their contacts commonly connected to the contacts of said normally open relay means and each of said normally open relay means including an activating coil including two ends having one of said ends connected to one of the poles of said source means;

d. a plurality of elapsed time meters connected in parallel with said corresponding activating coils; and e. a plurality of switch means connected in series with the other end of said coil and elapsed time meter combination and the other end of said switch means being connected to the other contact of said normally closed relay means so that when any of said switch means is closed said corresponding elapsed time meter connected to said switch means is activated thereby measuring the time said equipment is used outside said predetermined schedule.

2. The device set forth in claim 1 further comprising circuit breaker means to protect said device from overloading.

* * * * *